United States Patent [19]

Ridenour

[11] Patent Number: 5,065,925

[45] Date of Patent: Nov. 19, 1991

[54] TAPE DISPENSING DEVICES

[76] Inventor: Carlene Ridenour, P.O. Box 1, Edmon, Pa. 15630

[21] Appl. No.: 487,404

[22] Filed: Mar. 1, 1990

Related U.S. Application Data

[63] Continuation-in-part of Ser. No. 290,369, Dec. 29, 1988, abandoned.

[51] Int. Cl.[5] ..... B26F 3/02; B65D 85/672

[52] U.S. Cl. ..... 225/78; 225/47

[58] Field of Search ..... 225/77, 78, 79, 47, 225/48, 49, 58, 59, 65, 66, 42; 224/162, 252; 206/411

[56] References Cited

U.S. PATENT DOCUMENTS

| | | | |
|---|---|---|---|
| 1,818,514 | 8/1931 | Whitaker | 224/162 X |
| 2,581,190 | 1/1952 | Hodges | 225/78 |
| 2,640,656 | 6/1953 | Donkin | 225/77 X |
| 2,929,540 | 3/1960 | Carey | 225/47 |
| 2,963,208 | 12/1960 | Yates et al. | 225/78 |
| 4,252,258 | 2/1981 | Plummer | 225/78 X |
| 4,271,962 | 6/1981 | Stepanski | 206/411 |
| 4,493,446 | 1/1985 | Wirth | 225/78 X |
| 4,580,347 | 4/1986 | McKnight | 224/252 X |
| 4,606,485 | 8/1986 | Rankin | 225/78 |
| 4,648,538 | 3/1987 | Lien | 225/78 |
| 4,821,934 | 4/1989 | Alessi et al. | 224/252 |

FOREIGN PATENT DOCUMENTS

| | | | |
|---|---|---|---|
| 2233012 | 1/1975 | France | 224/252 |
| 1083587 | 9/1967 | United Kingdom | 225/47 |

*Primary Examiner*—Mark Rosenbaum
*Assistant Examiner*—Rinaldi Rada

[57] ABSTRACT

A device for the dispensing of tape includes a spindle for carrying a roll of tape, a cutter for severing tape pulled from the roll, and a clip for clipping the spindle and cutter to an article of clothing. In another aspect of the invention, a device is provided which includes a plate, a core extending laterally from one side of the plate, and a clip on the other side of the plate.

7 Claims, 3 Drawing Sheets

TAPE DISPENSING DEVICES

CROSS-REFERENCE TO RELATED APPLICATIONS

This is a continuation-in-part of my earlier application Ser. No. 07/290,369 filed 12/29/88, now abandoned, for Tape Dispensing Devices.

TECHNICAL FIELD

This invention relates to devices for the dispensing of tape.

DISCLOSURE OF INVENTION

It is an object of the present invention to make the ordinary disposable tape dispenser more flexible in its use.

This invention enables a disposable tape dispenser to be clipped onto a belt, or pocket, etc., thereby giving the user a free hand to hold maybe a sign, decorations for parties, posters, etc., while the tape dispenser is clipped to the belt, or pocket. The dispenser is secured and easy to use with one hand. The right amount of tape can be dispensed. The tape is easy to locate, positioned for convenience, and readily accessible. It is no longer necessary to fumble around, trying to remember where the tape was left behind.

The invention can be used in conjunction with the disposable products already being marketed, or marketed devices can be modified on the basis of this invention.

These as well as other objects which will become apparent from the disclosure which follows can be achieved, according to the invention, by devices broadly defined as follows:

A device for the dispensing of tape includes a spindle means for carrying a roll of tape, a cutter means for servering tape pulled from the roll, and a clip means for clipping the spindle means and cutter means to an article of clothing.

A device also according to the invention includes a plate, a core means extending laterally from one side of the plate, and a clip means on the other side of the plate.

MODES OF CARRYING OUT OF THE INVENTION

In the description which follows, like or similar structural members bear the same numeral designations from embodiment to embodiment.

Figure 1C:
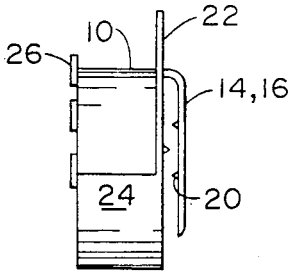
FIG. 1C is a view taken in the direction of arrow C in FIG. 1A.
Figure 1A:
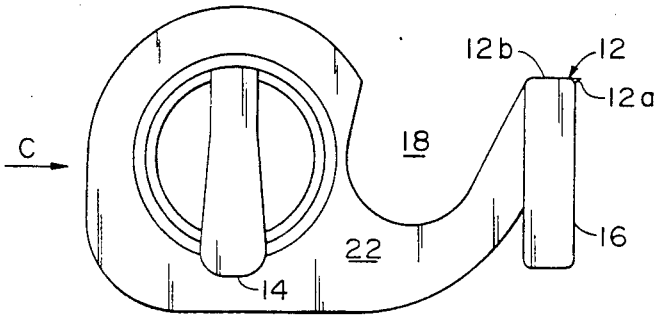
FIG. 1A is a front view of a device according to the present invention.
Figure 1D:
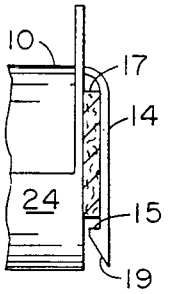
FIG. 1D is a view as in FIG. 1C of a modification of the device of FIGS. 1A–1C.
Figure 1B:
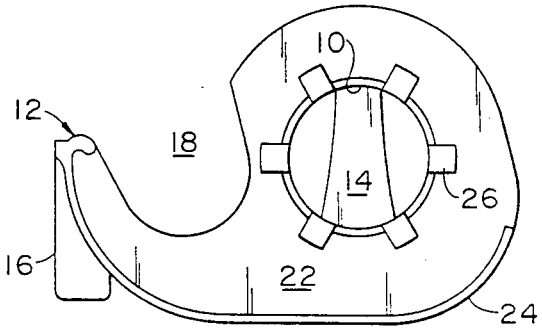
FIG. 1B is a back view of the device of FIG. 1A.

With reference first to FIGS. 1A to 1C, a device of the invention, for the dispensing of tape, comprises a spindle 10 for carrying a roll of tape (not shown), a cutter 12 for severing tape pulled from the roll, and a clip 14, 16 for clipping the spindle and cutter to an article of clothing, such as a belt or pants top. Cutter 12 has a ridge of teeth 12a, against which tape is pulled for cutting, and a platform 12b for holding tape stuck in an extended position. Depression 18 permits grasping the tape stuck to the platform for drawing a new length of tape from a roll on spindle 10.

The clip has a torque resisting feature for resisting torque around the spindle. The torque arises from pulling tape against the cutter for servering a length of tape or from drawing a new length of tape from a roll on the spindle.

The torque resisting feature is achieved, for example, by cones 20, which may be on the one or the other leg of the clip.

The torque resisting feature may also be provided by the dividing of the clip into two parts 14 and 16, part 14 being in the region of the spindle and part 16 in the region of the cutter.

The torque resisting feature may additionally be reinforced by the modification shown in FIG. 1D, where a ledge 15 on clip part 14 can hit against belt 17, or a waistband, should the squeezing action provided by the clip and cones not be enough to resist torque completely, for instance when tape is being pulled from a roll of tape on spindle 10. Incline 19 provides for easy pushing of the clip part 14 onto the belt.

According to one embodiment of the invention, the clip parts are constructed by making use of the panel 22 which forms a backbone for the whole structure. The clip parts are on one side of the panel, with one leg of the clip parts being provided by panel and the other leg extending out of the panel, as shown particularly in FIG. 1C. The spindle 10 and cutter 12 extend laterally from the other side of the panel, such also being indicated in FIG. 1C, although the cutter is hidden behind the spindle. Base 24 extends laterally likewise from the other side, reaches along the whole underside of the panel, and curls around to form platform 12. This base lends rigidity to the panel and provides support for the device on a table, when it is not being worn by a user.

The entire device may be made from a transparent plastic material based on polymer chemistry. Shown on the end of the spindle far from panel 22 are tabs 26, which are heat bonded in place, or bent over as part of the original spindle, after placement of a roll of tape on the spindle. A paper panel (not shown) will typically be placed between the tabs 26 and the roll of tape and will carry name of tape manufacturer, item number, tape size, advantages, etc..

As will be recognized, the devices of FIGS. 1A to 1D differ essentially from what is known (for instance, in the form of the disposable dispenser which comes with Lepages's Item No. 5910, ½"×600" INVISIBLE TAPE) in that device of the invention has a cli 14, 16 and torque resisting features, such that the device may be worn and used on a belt or pants top.

The device of FIGS. 2A–2E provides another approach to the invention. The known device, on which FIGS. 1A–1D builds, has a straight-through hole along the axis of spindle 10—thus, no clip 14 blocking the way. In the embodiment of FIGS. 2A–2E, the spindle 10 of the known device serves as a sleeve on a core means (in the form of a core or core cap) to form a combined spindle means for carrying a roll of tape.

Figure 2A:
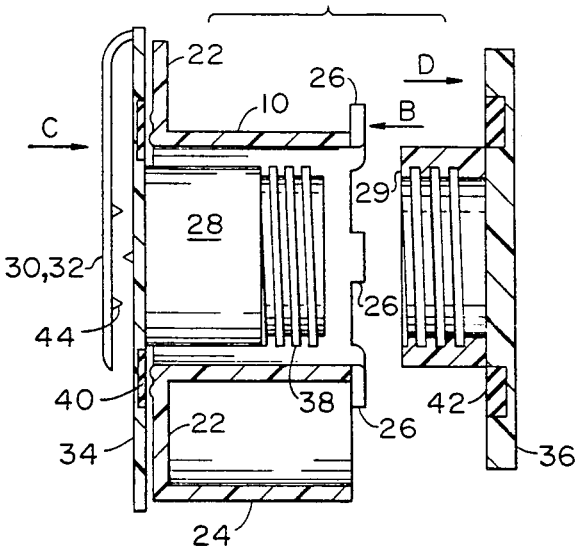
FIG. 2A is a cross-sectional view of an exploded, second device according to the invention, seen according to the cutting plane IIA—IIA of FIG. 2B.
Figure 2B:
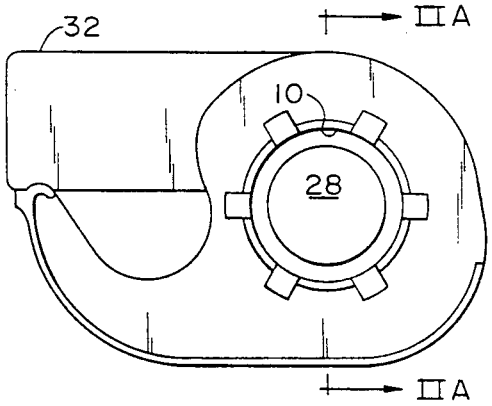
FIG. 2B is a view taken in the direction of arrow B in FIG. 2A.
Figure 2C:
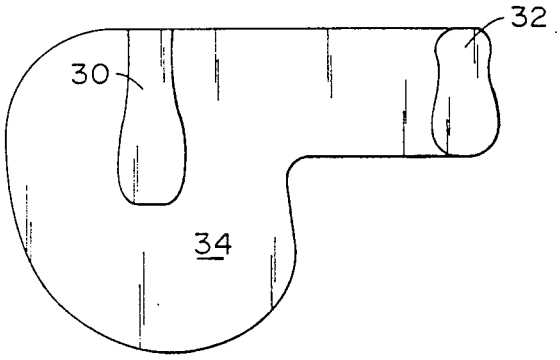
FIG. 2C is a view taken in the direction of arrow C in FIG. 2A.

FIG. 2A shows core 28 carrying clip 30, 32, with interposition of plate 34, and associated with a disposable tape dispenser, for instance a known one as above referenced, exhibiting a spindle 10, panel 22, base 24, and tabs 26. Plate 34 serves in conjunction with plate 36, when the core cap 29 of plate 36 is threaded onto threads 38 on core 28, for resisting rotation of the sleeve (spindle 10) on the core, i.e. for preventing rotation of the sleeve on the core when tape is torn against cutter 12. The assembled unit, with tape dispenser, is shown in FIG. 2E. Since, as explained above, the sleeve, spindle 10, forms one piece with panel 22, base 24, and cutter 12, the known device becomes locked to form one unit with the device of FIG. 2A, when plate 36 has been screwed onto the exposed core end in FIG. 2B. Washer-shaped rubber inlays are provided at 40 and 42 to improve the locking. FIG. 2E shows tabs 26 sunk into washer 42 and annular protrusions on the other side of the tape dispenser sunk into washer 40. FIG. 2E also illustrates that fact that the sleeve, spindle 10, sits on the outer surface of core cap 29 in the assembled mode of this embodiment.

The device of FIG. 2A has clip 30, 32 likewise with torque resisting features for resisting torque around the spindle. As in the embodiment of FIGS. 1A to 1C, this is achieved by cones 44 and by an extension of plate 34 to secure separation of the clip into clip parts 30 and 32, as shown in FIG. 2C. Clip part 32 is positioned to be alongside cutter 12, and, by the locking of the known device achieved by plate 36, counteracts the twist at clip 30 otherwise caused by tearing tape against cutter 12.

Figure 2D:
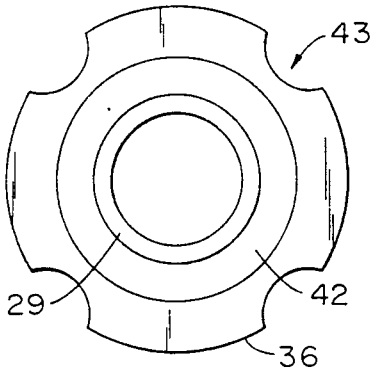
FIG. 2D is a view taken in the direction of arrow D in FIG. 2A.
Figure 2E:
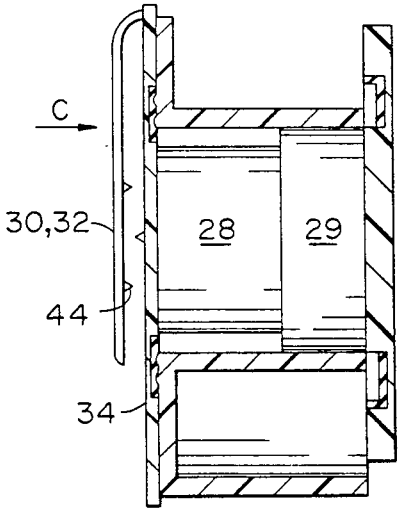
FIG. 2E is a view essentially as in FIG. 2A, but showing the device in assembled rather than exploded view.

FIG. 2D shows that plate 36 is provided with finger depressions 43 to assist in screwing core cap 29 tightly onto core 28.

Figure 3:
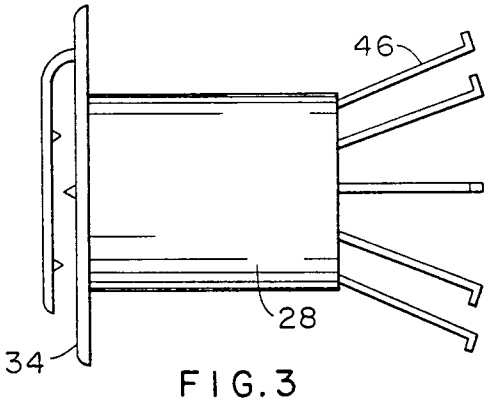
FIG. 3 is a modification of the embodiment of FIG. 2A, seen as in 2A.

In the embodiment of FIG. 3, flexible prongs 46 on core 28 work against an inner end of the sleeve, spindle 10, of a tape dispenser when it is placed on core 28, both to force the sleeve against plate 34 and to lock the known device to the core. The prongs may also be formed with a back curl, to interlock with tabs 26.

Figure 3A:
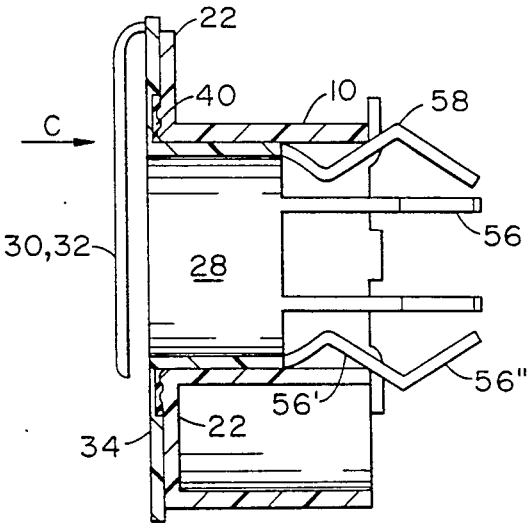
FIG. 3A is a view as in FIG. 3 of a modification of FIG. 3.

FIG. 3A modifies, and builds on, the ideas in the embodiment of FIG. 3. A tape dispenser of the above-referenced, known type is shown assembled on the device. Six prongs 56 (the cross section is taken such that four appear in FIG. 3A) are in an inwardly depressed state, such that their resilience is causing their outwardly directed inclines 56' to push against the end of the sleeve, spindle 10, to urge the tape dispenser into frictional engagement with plate 34 and washer 40.

Inclines 56' also extend between the tabs 26, so as to interfere with the tabs, should the tabs rotate due to slippage in the frictional engagement, to provide a locking effect in addition to that provided by the frictional engagement.

As shown, the sleeve, spindle 10, sits on the outer surface of core 28 in the assembled mode of this embodiment. For assembly, the inwardly directed inclines 56" and the resilience of the prongs 56 provide that the tape dispenser can simply be brought into the position shown in FIG. 3A by pushing the end of the sleeve adjoining panel 22 against the inclines 56". This deflects the prongs 56 inwards. The vertices 58 ride on the inner surface of the sleeve, until, with panel 22 against plate 34, inclines 56' have reached their positions as shown in FIG. 3A. It may be necessary to rotate the tape dispenser, such that the prongs 56 spring into position between the tabs 26.

Figure 4:
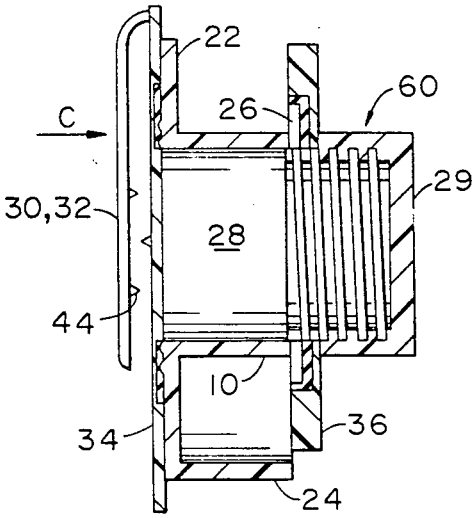
FIG. 4 is a view as in FIG. 2E of a modification of the embodiment of FIGS. 2A–2E.

FIG. 4 shows the assembled mode of an alternate embodiment to that of FIGS. 2A–2E. In this embodiment, core 28 extends through plate 36 and into core cap 29, such that the end of core 28 comes, for instance, to location 60. Twirling of the outer diameter of the core cap between thumb and fingers, or rotation of plate 36 using depressions 43 (FIG. 2D), threads the internal threads of the core cap sufficiently onto the external threads on the end of the core, such that the tape dispenser becomes locked in tight frictional engagement between the plates 34 and 36, with protrusions, such as the tabs 26, sunk into the rubber washers. In this embodiment, the inner diameter of the sleeve sits on the outer diameter of the core.

Figure 5:
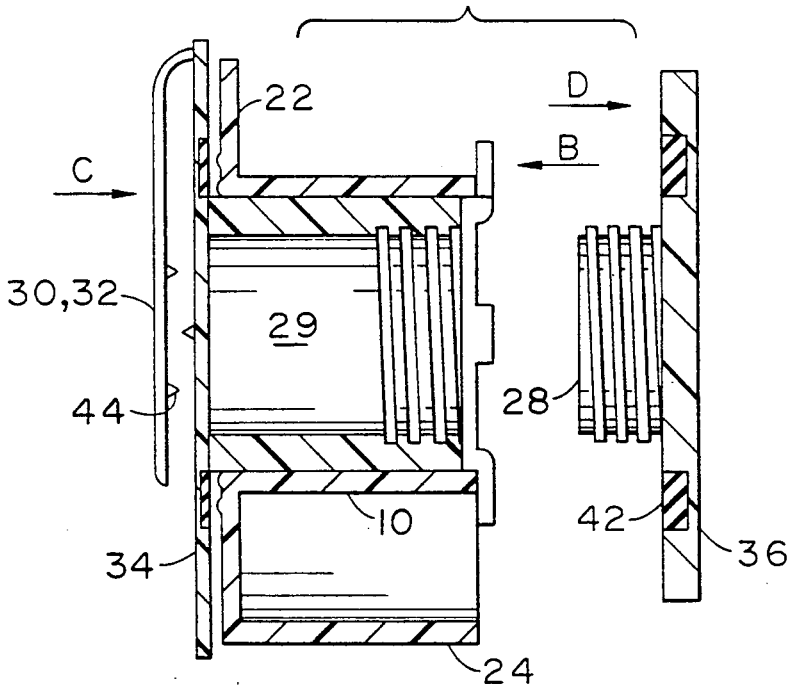
FIG. 5 is a view as in FIG. 2A of a modification of the embodiment of FIGS. 2A–2E.

FIG. 5 is an exploded view of another embodiment similar to that of FIGS. 2A–2E. Here, the sleeve sits on the core cap 29 attached to, or a part of, plate 34. Assembly is effected by rotating core 28, which is attached to, or a part of, plate 36, for instance using depressions 43 (FIG. 2D), to obtain threading of the core into the core cap, in order to bring about squeezing, frictional engagement of the tape dispenser between the plates.

What is claimed is:

1. A device for the dispensing of tape, comprising a spindle means for carrying a roll of tape, a cutter means for serving tape pulled from the roll, and a clip means for clipping the spindle means and cutter means to an article of clothing, the spindle means comprising a core means for supporting a sleeve and a sleeve supported on the core means for carrying a roll of tape, the sleeve being connected to the cutter means by a panel means for connecting, the sleeve and cutter means extending laterally from the panel means, the clip means being attached to the core means, and rotation preventing means for preventing rotation of the sleeve on the core means, the rotation preventing means comprising plates on ends of the core means, the clip means lying on one side of a first of said plates, the core means extending laterally from the other side of the first plate to a second of said plates.

2. A device as claimed in claim 1, the core means comprising a core attached to one of said plates and a core cap attached to another of said plates, the core cap threading on the core.

3. A device as claimed in claim 2, the core attached to said first plate, the core cap attached to said second plate, the sleeve contacting the core cap.

4. A device as claimed in claim 2, the core attached to said first plate, the core cap attached to said second plate, the sleeve contacting the core.

5. A device as claimed in claim 2, the core attached to said second plate, the core cap attached to said first plate, the sleeve contacting the core cap.

6. A device for the dispensing of tape, comprising a spindle means for carrying a roll of tape, a cutter means for severing tape pulled from the roll, and a clip means for clipping the spindle means and cutter means to an article of clothing, the spindle means comprising a core means for supporting a sleeve and a sleeve supported on the core means for carrying a roll of tape, the sleeve being connected to the cutter means by a panel means for connecting, the sleeve and cutter means extending laterally from the panel means, the clip means being attached to the core means, and rotation preventing means for preventing rotation of the sleeve on the core means, the rotation preventing means comprising plates on ends of the core means, the rotation preventing means further comprising rubber inlays on the plates.

7. A device for the dispensing of tape, comprising a spindle means for carrying a roll of tape, a cutter means for servering tape pulled from the roll, and a clip means for clipping the spindle means and cutter means to an article of clothing, the spindle means comprising a core means for supporting a sleeve and a sleeve supported on the core means for carrying a roll of tape, the sleeve being connected to the cutter means by a panel means for connecting. the sleeve and cutter means extending laterally from the panels means, the clip means being attached to the core means, and rotation preventing means for preventing rotation of the sleeve on the core means, the rotation preventing means comprising prongs, the sleeve having tabs, the prongs lying between the tabs for providing a rotation-preventing effect.

* * * * *